US010964496B2

(12) United States Patent
Rusev et al.

(10) Patent No.: US 10,964,496 B2
(45) Date of Patent: Mar. 30, 2021

(54) MANUAL CLOSE ASSIST CONTROL MECHANISM

(71) Applicant: S&C Electric Company, Chicago, IL (US)

(72) Inventors: Tsvetan Rusev, Morton Grove, IL (US); Adam Gardner, Chicago, IL (US); Michael Stamer, Northbrook, IL (US)

(73) Assignee: S&C Electric Company, Chicago, IL (US)

( * ) Notice: Subject to any disclaimer, the term of this patent is extended or adjusted under 35 U.S.C. 154(b) by 0 days.

(21) Appl. No.: 16/744,809

(22) Filed: Jan. 16, 2020

(65) Prior Publication Data

US 2020/0251294 A1 Aug. 6, 2020

Related U.S. Application Data

(60) Provisional application No. 62/799,415, filed on Jan. 31, 2019.

(51) Int. Cl.

| | |
|---|---|
| ***H01H 33/662*** | (2006.01) |
| ***H01H 33/38*** | (2006.01) |
| ***H01H 33/666*** | (2006.01) |
| ***H01H 51/22*** | (2006.01) |
| ***H01F 7/18*** | (2006.01) |

(52) U.S. Cl.

CPC ..... *H01H 33/66207* (2013.01); *H01F 7/18* (2013.01); *H01H 33/38* (2013.01); *H01H 33/666* (2013.01); *H01H 51/2209* (2013.01)

(58) Field of Classification Search

CPC ..... H01H 33/66207; H01H 33/666; H01H 33/38; H01H 51/2209; H01H 50/32; H01H 71/24; H01H 71/2436; H01H 71/2463; H01H 71/2472; H01H 71/52; H01H 71/521; H01H 71/68; H01H 2071/665; H01H 33/6662; H01H 2033/6667; H01F 7/18; H01F 7/1844; H01F 2007/185

USPC ..... 218/118, 120, 140, 141, 153, 154

See application file for complete search history.

(56) References Cited

U.S. PATENT DOCUMENTS 3,471,814 A * 10/1969 Burdett ..... H01F 7/1638 335/174
3,663,906 A 5/1972 Barkan et al.
4,032,870 A 6/1977 Oppel et al.

(Continued)

OTHER PUBLICATIONS

The International Search Report and the Written Opinion for International Application No. PCT/US2020/013852 dated Apr. 2, 2020. (8 pages).

*Primary Examiner* — William A Bolton

(57) ABSTRACT

A method for closing an actuator in a magnetically actuated switch assembly, where the actuator includes an armature and a winding, and the switch assembly includes a manual actuation device coupled to one end of the armature and a movable terminal in a vacuum interrupter coupled to an opposite end of the armature. The method includes commencing a closing operation of the actuator using the manual actuation device to move the armature towards a closed latch position, detecting that the actuator is being manually closed, and energizing the winding to assist moving the armature to the closed latch position when the armature gets to a predetermined distance from the closed latch position.

19 Claims, 1 Drawing Sheet

(56) References Cited

U.S. PATENT DOCUMENTS

| | | | | |
|---|---|---|---|---|
| 5,912,604 | A * | 6/1999 | Harvey | H01H 33/6662 218/138 |
| 6,198,062 | B1 * | 3/2001 | Mather | H01H 33/022 218/120 |
| 6,285,270 | B1 | 9/2001 | Lane et al. | |
| 6,373,675 | B1 * | 4/2002 | Yamazaki | H01H 33/6662 200/237 |
| 6,580,345 | B2 * | 6/2003 | Akita | H01H 33/285 218/141 |
| 7,280,019 | B2 | 10/2007 | Kolb et al. | |
| 2005/0067380 | A1 * | 3/2005 | Rhein | H01H 33/6662 218/118 |
| 2005/0139579 | A1 * | 6/2005 | Sakamoto | H01H 33/6661 218/118 |
| 2006/0022780 | A1 | 2/2006 | Harvey et al. | |

* cited by examiner

MANUAL CLOSE ASSIST CONTROL MECHANISM

CROSS-REFERENCE TO RELATED APPLICATION

This application claims the benefit of priority from the U.S. Provisional Application No. 62/799,415, filed on Jan. 31, 2019, the disclosure of which is hereby expressly incorporated herein by reference for all purposes.

BACKGROUND

Field

This disclosure relates generally to a method for closing an actuator in a magnetically actuated switch assembly and, more particularly, to a method for closing an actuator in a magnetically actuated switch assembly that includes commencing a closing operation of an actuator in the switch assembly using a manual actuation device.

Discussion of the Related Art

An electrical power distribution network, often referred to as an electrical grid, typically includes a number of power generation plants each having a number of power generators, such as gas turbines, nuclear reactors, coal-fired generators, hydro-electric dams, etc. The power plants provide power at a variety of medium voltages that are then stepped up by transformers to a high voltage AC signal to be provided on high voltage transmission lines that deliver electrical power to a number of substations typically located within a community, where the voltage is stepped down to a medium voltage. The substations provide the medium voltage power to a number of three-phase feeder lines. The feeder lines are coupled to a number of lateral lines that provide the medium voltage to various distribution transformers, where the voltage is stepped down to a low voltage and is provided to a number of loads, such as homes, businesses, etc.

Periodically, faults occur in the distribution network as a result of various things, such as animals touching the lines, lightning strikes, tree branches falling on the lines, vehicle collisions with utility poles, etc. Faults may create a short-circuit that increases the load on the network, which may cause the current flow from the substation to significantly increase, for example, several times above the normal current, along the fault path. This amount of current causes the electrical lines to significantly heat up and possibly melt, and also could cause mechanical damage to various components in the substation and in the network.

Power distribution networks of the type referred to above typically include a number of switching devices, breakers, reclosers, interrupters, etc. that control the flow of power throughout the network. A vacuum interrupter is a switch that has particular application for these types of devices. A vacuum interrupter employs opposing contacts, one fixed and one movable, positioned within a vacuum enclosure. When the interrupter is opened by moving the movable contact away from the fixed contact the arc that is created between the contacts is quickly extinguished by the vacuum. A vapor shield is provided around the contacts to contain the arcing. For certain applications, the vacuum interrupter is encapsulated in a solid insulation housing.

These types of vacuum interrupters are sometimes employed in fault interrupter devices, such as single-phase self-powered magnetically actuated reclosers. These types of magnetically actuated reclosers generally include a solenoid type actuator having an armature that is moved by an electrical winding to open and close the vacuum interrupter contacts, where the armature and a stator provide a magnetic path for the flux produced by the winding. The winding is de-energized after the actuator is moved to the open or closed position, and permanent magnets are used to hold the armature against a latching surface in both the open and closed position. Reclosers of this type automatically open the vacuum interrupter contacts in response to the detection of fault current, and are often coordinated with other reclosers and breakers so that the first recloser upstream of the fault is the only one that opens to limit the number of loads that do not receive power. When the recloser opens in response to detecting a fault, it will close shortly thereafter to determine if the fault remains. If the fault current is detected again, then the recloser will automatically open again and remain open.

It is sometimes desirable to provide a manual actuation device in connection with a magnetically actuated recloser of this type for manually closing and opening the vacuum interrupter contacts when no power is available to the recloser for electrically opening and closing the contacts. For example, when the recloser is first installed in a live circuit, such as on a utility pole, where the vacuum interrupter is in the open position, but power is not available because the contacts are open and unable to electrically close the vacuum interrupter, it is desirable for convenience purposes to be able to manually close the contacts. Further, the manual actuation device needs to be configured so that if a fault occurs in the circuit, or is present in the circuit when the vacuum interrupter is mechanically closed, the contacts will immediately open electrically as described above without the manual device interfering with the electrical operation of the actuator. Further, there may be occurrences where it is desirable to manually open the contacts when the vacuum interrupter is in operation without using the actuator.

There may be an occurrence where the contacts of a vacuum interrupter, breaker, recloser or other type of switch are welded closed because of high fault current. For example, an unknown fault may be on the line during the manual closing operation of a recloser of the type referred to above, where the vacuum interrupter is switched into the high fault current, which could cause the contacts to weld. If the weld cannot be removed by operating the actuator, then a farther upstream recloser will need to be opened to clear the fault.

When power is provided to the windings in a magnetically actuated recloser and the actuator is operated electrically, the armature will translate from one latching surface to another latching surface. If the armature is moved from the open position to the closed position by a manual activation device and not by powering the winding, the last magnetic state of the armature and the stator is for the open position, where the magnetic domains in the material are aligned in a way to support the open state. More particularly, when the armature is manually moved to the closed position the only magnetic force acting on the armature is produced by the permanent magnets through the stator and the armature that are magnetically polarized in the opposite direction. This leads to a lower latching force between the armature and the latching surface when the actuator is mechanically closed to the closed position. At the instant the armature hits the latching surface the reduced magnetic force may not be sufficient to hold the armature in the closed state and the armature bounces off the latching surface. In this state the actuator does not exert any external force on the vacuum interrupter contacts, which are held together loosely by atmospheric pressure acting on the vacuum interrupter bellows, which could create arcing and may cause the contacts to weld together. The armature also experiences bounce during electrical operations, however the permanent magnets are assisted by the force produced by the winding. Instead of bouncing away, the armature chatters against the latching surface and settles in the latched position.

SUMMARY

The following discussion discloses and describes a method for closing an actuator in a magnetically actuated switch assembly, where the actuator includes an armature and a winding, and, in one non-limiting embodiment, the switch assembly includes a manual actuation device coupled to one end of the armature and a movable terminal in a vacuum interrupter coupled to an opposite end of the armature. The method includes commencing a closing operation of the actuator using the manual actuation device to move the armature towards a closed latch position, detecting that the actuator is being manually closed, and energizing the winding to assist moving the armature to the closed latch position when the armature gets to a predetermined distance from the closed latch position.

Additional features of the disclosure will become apparent from the following description and appended claims, taken in conjunction with the accompanying drawings.

DETAILED DESCRIPTION OF THE EMBODIMENTS

The following discussion of the embodiments of the disclosure directed to a method for manually closing an actuator in a magnetically actuated switch assembly that includes providing an electrically assist is merely exemplary in nature, and is in no way intended to limit the disclosure or its applications or uses. For example, the discussion herein refers to the method being applicable to a magnetically actuated fault recloser including a vacuum interrupter. However, as will be appreciated by those skilled in the art, the method will have application for other types of switches.

Figure 1:
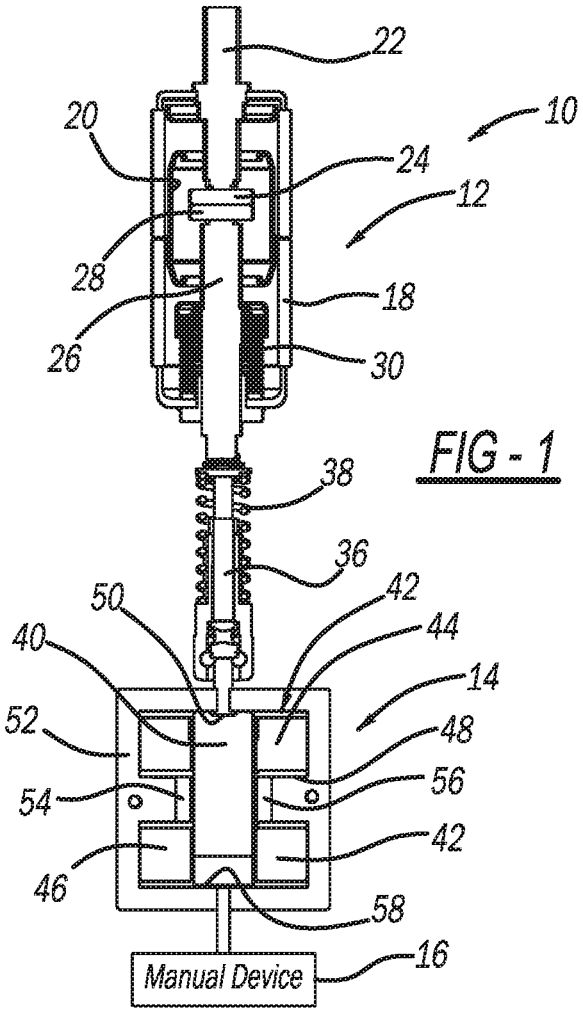
FIG. 1 is a side view of an internal portion of a magnetically actuated switch assembly including a vacuum interrupter.

FIG. 1 is a side view of a magnetic latching actuator operated switch assembly 10 including a vacuum interrupter 12, a solenoid or magnetic actuator 14 that electrically opens and closes the vacuum interrupter 12, and a manual actuation device 16 that manually opens and closes the vacuum interrupter 12, where an outer insulation housing of the vacuum interrupter 12 and an outer protective housing of the actuator 14 and the device 16 have been removed. The switch assembly 10 has particular application as a single-phase self-powered magnetically actuated fault recloser for use in medium voltage power distribution networks. The vacuum interrupter 12 includes an enclosure 18 defining a vacuum chamber 20, a fixed upper terminal 22 extending through a top end and into the chamber 20 and including a contact 24 and a movable lower terminal 26 extending through a bottom end and into the vacuum chamber 20 and including a contact 28, where a bellows 30 allows the movable terminal 26 to slide without affecting the vacuum in the chamber 20. The vacuum interrupter 12 is shown in the closed position where the contacts 24 and 28 are in contact with each other.

The switch assembly 10 further includes a dielectric drive rod 36 extending through a spring 38, where one end of the drive rod 36 is connected to the lower terminal 26 and an opposite end of the drive rod 36 is connected to an armature 40 in the actuator 14. When the switch assembly 10 is in an open state and the actuator 14 is commanded to close the vacuum interrupter 12, current flow is provided in one direction through a split winding 42 having an upper winding-half 44 and a lower winding-half 46 defining a space 48 therebetween, where a magnetic path is provided by the armature 40 and an E-shaped stator 52. In response, the armature 40 is drawn upward, which also moves the rod 36 and the lower terminal 26 upward so that the contact 28 engages the contact 24, where continued movement of the armature 40 to a closed latch position against a latch surface 50 compresses the spring 38 to increase the force of the contact 26 against the contact 24.

When the armature 40 is latched closed the winding 42 is de-energized and a pair of permanent magnets 54 and 56 positioned in the space 48 on opposite sides of the armature 40 hold the armature 40 in the closed latch position and the spring 38 under compression, where the actuator 14 is shown in the closed position in FIG. 1. When the switch assembly 10 is in the closed state and the actuator 14 is commanded to open the vacuum interrupter 12, current flow is provided in the opposite direction through the split winding 42 and the armature 40 is drawn downward with help from the spring 38. The rod 36 and the lower terminal 26 also move downward so that the contact 28 disengages the contact 24, where continued movement of the armature 40 proceeds to an open latch position against latch surface 58. The permanent magnets 54 and 56 also hold the armature 40 in the open latch position when the winding 42 is de-energized. No details of the device 16 are shown as it can be any mechanical device suitable for the purposes discussed herein.

Figure 2:
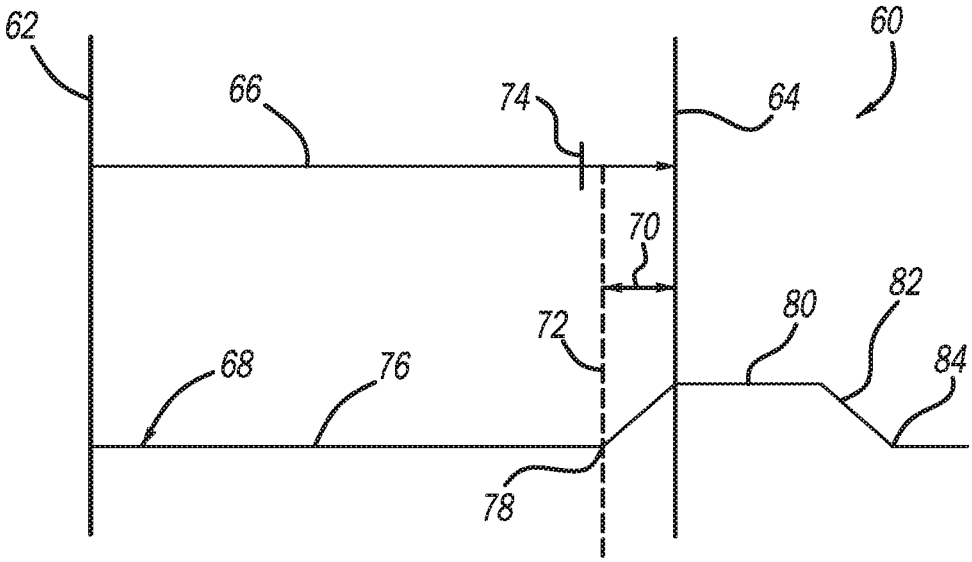
FIG. 2 is an illustration showing an operation for manually closing an actuator in the switch assembly shown in FIG. 1 that includes providing an electrically assist.

FIG. 2 is an illustration 60 showing an operation for assisting with the closing of the actuator 14 when it is being mechanically closed by the manual activation device 16 by providing a small amount of electrical power to the actuator 14, i.e., the winding 42, if available, during the manual closing operation so as to maintain a more reliable magnetic latch of the armature 40 in the closed position. Line 62 represents the position of the armature 40 when the actuator 14 is in the open latch position and the contacts 24 and 28 are open, and line 64 represents the position of the armature 40 when the actuator 14 is in the closed latch position and the contacts 24 and 28 are closed. Line 66 represents the position of the armature 40 over time as it moves from the open latch position to the closed latch position by operation of the mechanical device 16. Line 68 represents an electrical signal provided to the winding 42 over time to help move the armature 40 from the open latch position to the closed latch position, where the electrical signal is usually zero. Line 72 represents a maximum bounce of the armature 40 off of the latch surface 50 when the armature 40 impacts the surface during the closing operation, where a bounce region 70 is defined between the line 64 and the line 72. Point 74 represents the time that the contacts 24 and 28 are closed enough from movement of the armature 40 so that electrical power can be provided to the actuator 14 if there is available power, whether it be fault current or normal current, which occurs before the bounce region 70.

Before the position of the armature 40 reaches the line 72 and the armature 40 enters the bounce region 70, line portion 76 of the line 68 shows that no electrical power is being provided to the actuator 14. When the position of the armature 40 reaches the line 72, a small amount of electrical power is provided to the actuator 14 at point 78, which increases to line portion 80 of the line 68, that increases the force on the armature 40 impacting the latching surface 50. This amount of electrical power is likely significantly less than the electrical power that would be provided to the winding 42 if the actuator 14 was being closed by only electrical power. The electrical power provided to the winding 42 also acts to align the magnetic domains of the ferrous material of the armature 40 and the stator 52, thus increasing the magnetic latch force provided by the permanent magnets 54 and 56 so that the armature 40 is more reliably latched to the surface 50, which provides more contact pressure between the contacts 24 and 28. In other words, as the armature 40 approaches the closed state the winding 42 is briefly energized in a direction that polarizes the armature and stator material so that it can support higher latching forces when in the closed state. The electrical pulse provided to the winding 42 is maintained for a short period of time after the armature 40 is in the closed latch position, where the power ramps down on line portion 82 to zero at point 84. Some mechanism needs to be provided so that the switch assembly 10 knows that the actuator 14 is being manually closed. This mechanism can be any mechanism suitable for the purposes discussed herein, such as detecting the beginning of current flow through the vacuum interrupter 12 at the point 74.

The foregoing discussion discloses and describes merely exemplary embodiments of the present disclosure. One skilled in the art will readily recognize from such discussion and from the accompanying drawings and claims that various changes, modifications and variations can be made therein without departing from the spirit and scope of the disclosure as defined in the following claims.

What is claimed is:

1. A method for closing an actuator in a magnetically actuated switch assembly, the switch assembly including a manual actuation device coupled to the actuator, the method comprising:

commencing a closing operation of the actuator using the manual actuation device to move an armature in the actuator towards a closed latch position; and energizing a winding in the actuator to assist moving the armature to the closed latch position when the armature gets to a predetermined distance from the closed latch position.

2. The method according to claim 1 wherein the predetermined distance is a maximum bounce distance of the armature off of a latch surface at the closed latch position.

3. The method according to claim 1 wherein energizing the winding includes energizing the winding with less power than what is necessary to electrically close the actuator.

4. The method according to claim 1 further comprising detecting that the actuator is being manually closed so as to determine when to energize the winding.

5. The method according to claim 4 wherein the switch assembly includes a vacuum interrupter, and wherein detecting that the actuator is being manually closed includes determining when current begins to flow through the vacuum interrupter.

6. The method according to claim 5 wherein the armature is coupled to a switch contact in the vacuum interrupter.

7. The method according to claim 1 wherein the switch assembly is a single-phase self-powered magnetically actuated fault recloser for use in medium voltage power distribution network.

8. A method for closing an actuator in a magnetically actuated switch assembly, the actuator including an armature and a winding, switch assembly including a manual actuation device coupled to one end of the armature and a movable terminal in a vacuum interrupter coupled to an opposite end of the armature, the method comprising:

commencing a closing operation of the actuator using the manual actuation device to move the armature towards a closed latch position;

detecting that the actuator is being manually closed; and energizing the winding to assist moving the armature to the closed latch position when the armature gets to a predetermined distance from the closed latch position.

9. The method according to claim 8 wherein the predetermined distance is a maximum bounce distance of the armature off of a latch surface at the closed latch position.

10. The method according to claim 8 wherein energizing the winding includes energizing the winding with less power than what is necessary to electrically close the actuator.

11. The method according to claim 8 wherein detecting that the actuator is being manually closed includes determining when current begins to flow through the vacuum interrupter.

12. The method according to claim 8 wherein the switch assembly is a single-phase self-powered magnetically actuated fault recloser for use in medium voltage power distribution network.

13. A system for closing an actuator in a magnetically actuated switch assembly, the switch assembly including a manual actuation device coupled to the actuator, the system comprising:

a manual actuator being coupled to an armature of the magnetically actuated switch assembly and operable in a closing operation to move the armature in the actuator towards a closed latch position; and a current source coupled to a winding in the actuator that when energized provides current to the winding creating a magnetic force to assist moving the armature to the closed latch position when the armature gets to a predetermined distance from the closed latch position.

14. The system according to claim 13 wherein the predetermined distance is a maximum bounce distance of the armature off of a latch surface at the closed latch position.

15. The system according to claim 13 wherein the current source energizes the winding with less power than what is necessary to electrically close the actuator.

16. The system according to claim 13 further comprising sensor operably associated with the actuator to detect that the actuator is being manually closed and to provide a signal to current source to energize the winding.

17. The system according to claim 16 wherein the switch assembly includes a vacuum interrupter, and wherein the sensor determines when current begins to flow through the vacuum interrupter.

18. The system according to claim 17 wherein the armature is coupled to a switch contact in the vacuum interrupter.

19. The system according to claim 13 wherein the switch assembly is a single-phase self-powered magnetically actuated fault recloser for use in medium voltage power distribution network.

* * * * *